US006584720B1

(12) United States Patent
Johnson

(10) Patent No.: US 6,584,720 B1
(45) Date of Patent: Jul. 1, 2003

(54) GUN SIGHT ZERO CHECKING DEVICE

(76) Inventor: Wallace E. Johnson, Wejco Inst., 9112 Spring Br. Dr., Houston, TX (US) 77080

( * ) Notice: Subject to any disclaimer, the term of this patent is extended or adjusted under 35 U.S.C. 154(b) by 0 days.

(21) Appl. No.: 10/165,335

(22) Filed: Jun. 7, 2002

(51) Int. Cl.[7] ..... F41G 1/38
(52) U.S. Cl. ..... 42/120
(58) Field of Search ..... 42/120, 121

(56) References Cited

U.S. PATENT DOCUMENTS

| | | | | | |
|---|---|---|---|---|---|
| 1,295,075 | A | * | 2/1919 | Sheppard | 42/134 |
| 3,112,567 | A | * | 12/1963 | Flanagan | 42/121 |
| 3,908,282 | A | * | 9/1975 | Steffan | 42/121 |
| 4,057,905 | A | * | 11/1977 | Piaja | 42/121 |
| 4,090,305 | A | * | 5/1978 | Cassidy | 42/121 |
| 4,095,347 | A | * | 6/1978 | Steffan | 42/121 |
| 4,750,269 | A | * | 6/1988 | Townsend et al. | 42/121 |
| 5,150,527 | A | * | 9/1992 | Knoster | 42/121 |
| 5,222,302 | A | * | 6/1993 | DeBatty et al. | 42/121 |
| 5,396,708 | A | * | 3/1995 | Whitley | 42/121 |
| 6,061,918 | A | * | 5/2000 | Schnell | 42/121 |
| 6,332,286 | B1 | * | 12/2001 | Shen | 42/121 |
| 6,397,509 | B1 | * | 6/2002 | Langner | 42/116 |

* cited by examiner

*Primary Examiner*—Charles T. Jordan
*Assistant Examiner*—Jordan M Lofdahl
(74) *Attorney, Agent, or Firm*—John R Casperson

(57) ABSTRACT

A device is disclosed which enables a scoped firearm owner to determine whether a scope has lost zero due to being moved or hit. A blank cartridge form is attached to a second scope by a bracket. To use, the rifle is first sighted in, then the blank cartridge form is inserted to the rifle chamber and the device is rotated around the chamber until a stop device protruding from the bracket touches the rifle scope. The rifle is then placed in a firm rest with the crosshairs of the rifle scope centered on a target at a known distance and the second scope then adjusted to indicate the same aiming point. If the owner is later unsure whether the scope has lost zero, a target can be set up at the same distance, the device again mounted to the rifle, and the two scopes viewed to determine whether the same impact point is indicated. If it is not, the rifle scope can then be adjusted to the spot indicated by the device scope.

14 Claims, 3 Drawing Sheets

GUN SIGHT ZERO CHECKING DEVICE

BACKGROUND OF THE INVENTION

This invention relates to a device for checking the zero of a rifle.

Rifle sighting devices, particularly telescope sights, are susceptible to movement on account of being dropped or hit. A rifle which has been so damaged is said to have "lost its zero," meaning that the bullet impact point with respect to the reticle is not the same as it was before the damage was sustained. The damage is not always obvious, and in the past the only way to determine whether a rifle had lost its zero was by firing it. The zero of a rifle also generally varies between individuals, so another way a rifle can lose its zero is by being sighted in for another individual.

A rifle owner is thus, as a rule, not entirely certain whether a rifle as retained its zero unless they have recently fired it and it has not left their possession and control. The risk of lost zero is substantial in situations where the rifle has been out of the possession and control of the shooter. For hunters and competition shooters, the risk is greater whether the rifle has been shipped to location and handled by baggage handlers, for example. For police and military, the risk is greater where the rifle has been in the possession of an armorer for example, where it could have been dropped, or rezeroed to meet the needs of another individual.

Hunters often arrive at the hunt location at night for a hunt the next dawn, and do not have the opportunity to fire the rifle at an unimportant target to check its zero, or they simply do not wish to fire the rifle on account of possibly disturbing nearby game. Competition shooters are often not allowed by their rules to fire sighter shots prior to firing for record. Police and military marksman cannot rely on being able to go to a range to check the zero of their rifle between checking it out from the armorer or weapons custodian and arriving at a situation where they may be called upon to use it. If the rifle has lost its zero, the bullet from the rifle will not impact where the shooter believes it will, and the risk of a missed shot is high.

A device to permit the zero of a rifle to be quickly checked without firing the rifle would be very desirable.

It is an object of this invention to provide such a device.

SUMMARY OF THE INVENTION

In accordance with a first embodiment of the invention, there is provided an apparatus to which a scope can be mounted for checking the zero of a rifle. It comprises a mandrel, an arm, and a bracket. The mandrel closely fits the rifle chamber and has a longitudinal axis, a front end, and a back end. The arm is mounted to the back end of the mandrel and extends transversely outwardly from the longitudinal axis of the mandrel. A bracket is mounted to the arm for mounting a sighting device, for example, a telescopic sight, to sight along a path approximately parallel to the axis of the mandrel. Since many shooters already own a used telescopic sight, they can easily make use of the device as just described.

Although there are many different types of rifle cartridges, they are based on relatively few cases. For example, the 30-06 Springfield, 280 Remington, 270 Winchester, 25-06 Remington, 8 mm-06 and 35 Whelen all employ essentially the same 30-06 parent case with different neck diameters to accommodate different sized bullets. The same mandrel can be employed with all these different rifles. Other basic case designs widely used for many different calibers include the 7 mm Mauser and 7.62 mm NATO (0.308 Winchester) cartridges.

In another aspect, the invention provides a non-firing method to determine whether a rifle has retained its zero. The method comprises providing a rifle with a mounted rifle scope which has been sighted in for the rifle. A sight-in checker device as hereinabove described is provided, with a checker scope previously sighted in to coincide with the sight-in of the rifle scope mounted on the bracket when the checker device is mounted on the rifle in a predetermined position. The mandrel of the checker device is then positioned in the chamber of the rifle and the checker device is positioned in the predetermined position with respect to the rifle. The rifle is then positioned in a stable position with the rifle scope centered on a target and the checker scope is then viewed to whether it is also centered on the target. If it is not, the reticle of the rifle can be adjusted to the same impact point indicated by the checker device.

A method is thus provided for checking the sight-in of a rifle, and adjusting it if necessary, without firing a shot.

DETAILED DESCRIPTION OF THE INVENTION

Figure 3:
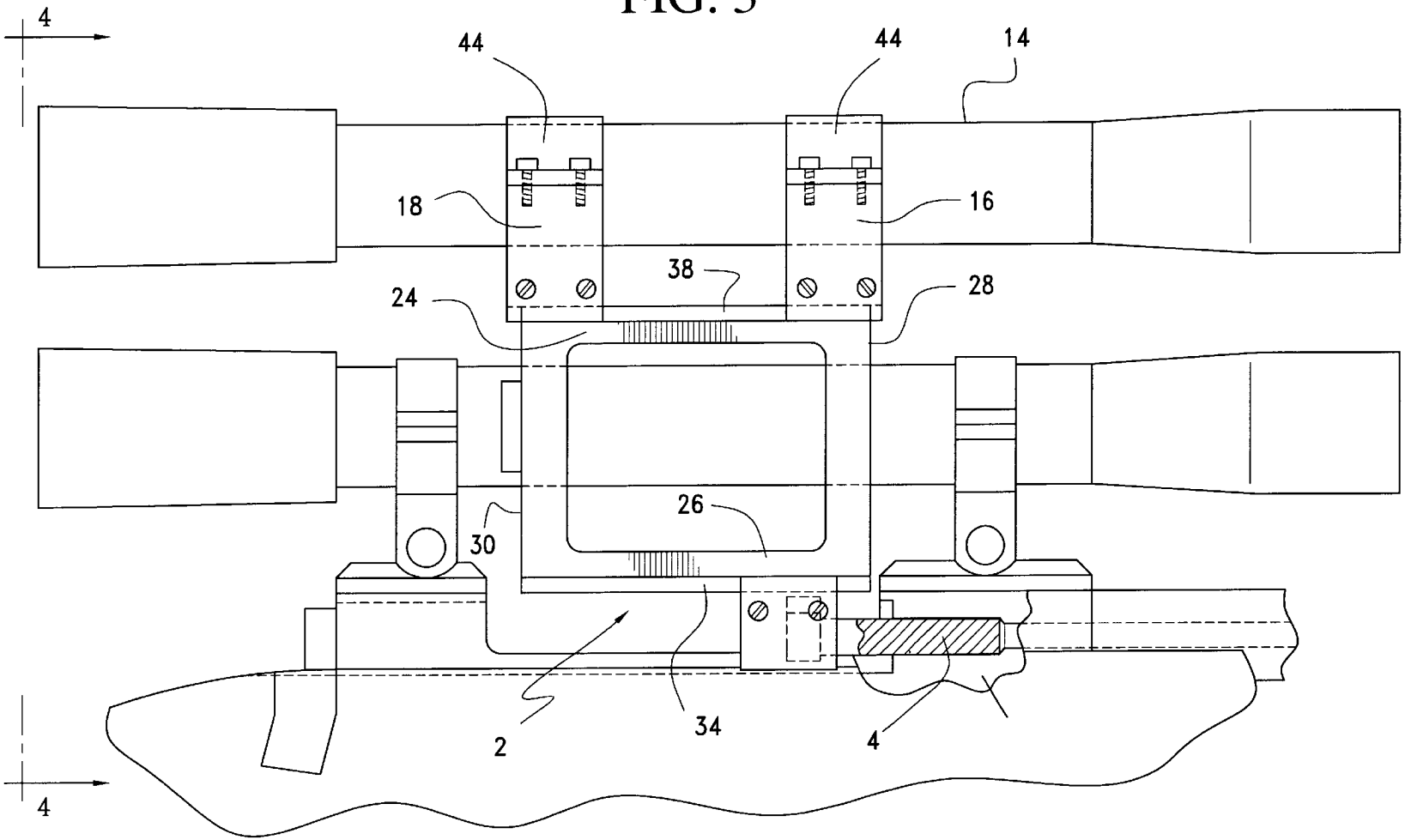
FIG. 3 is a side view of another embodiment of the invention in use on a rifle, portions of which are broken away and shown in cross section to facilitate an understanding of the use of the invention.

In accordance with a first embodiment of the invention, there is provided an apparatus 2 useful to make a device for checking the zero of a rifle. It comprises a mandrel 4, an arm 6, and a bracket 8. The mandrel closely fits the rifle chamber (see FIG. 3) and has a longitudinal axis, a front end 10, and a back end 12. The arm is mounted to the back end of the mandrel and extends transversely outwardly from the longitudinal axis of the mandrel. The bracket is mounted to the arm and is for mounting a sighting device, for example, a telescopic sight 14 (see FIG. 3), to sight along a path approximately parallel to the axis of the mandrel. Since many shooters already own a used telescopic sight, they can easily make use of the device as just described.

Figure 4:
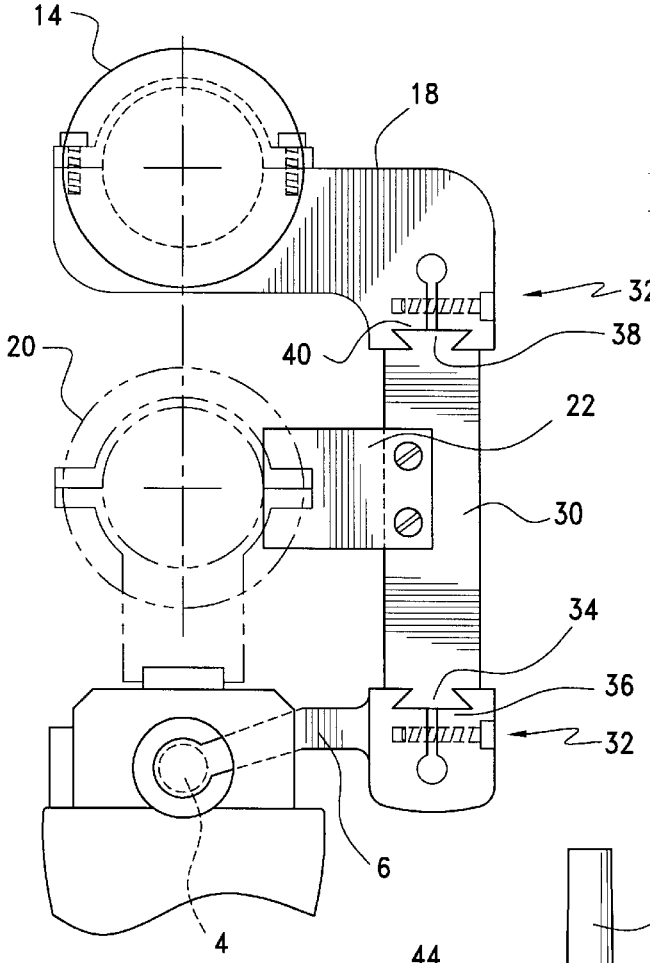
FIG. 4 is an end view of the device along lines 4–4 of FIG. 3.
Figure 2:
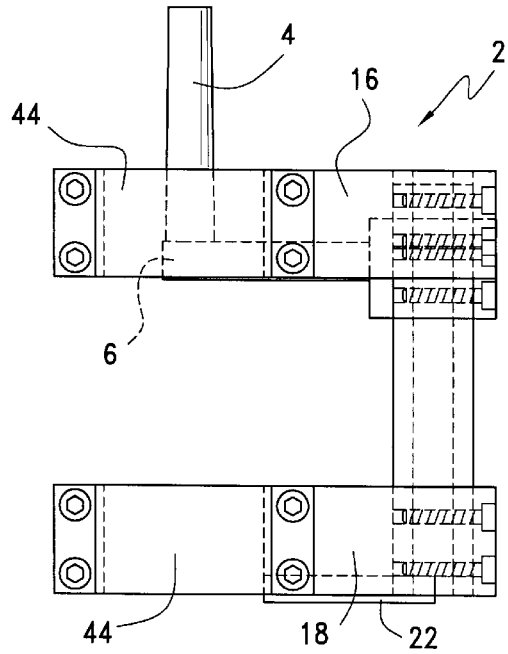
FIG. 2 is a top view of the device shown in FIG. 1.

Most any a sighting device can be mounted to the bracket, provided that it is mounted to sight along a path approximately parallel to the axis of the mandrel. Preferably, the sighting device comprises a scope which is mounted to a front extension leg 16 and a back extension leg 18 which are spaced apart from each other and extend transversely from the scope to connect the scope to the bracket. The extension legs are preferably sufficiently long to position the sighting device scope vertically above the rifle scope 20 (See FIG. 4).

A stop 22 protrudes transversely from the bracket in the direction of the arm. Preferably, the arm, the stop, and the pair of extension legs each extend transversely from the same side of the bracket and the stop is positioned between the arm and the pair of spaced apart extension legs. When in use, the stop contacts the existing rifle scope (see FIG. 4) to provide positive placement of the sighting device scope.

Figure 1:
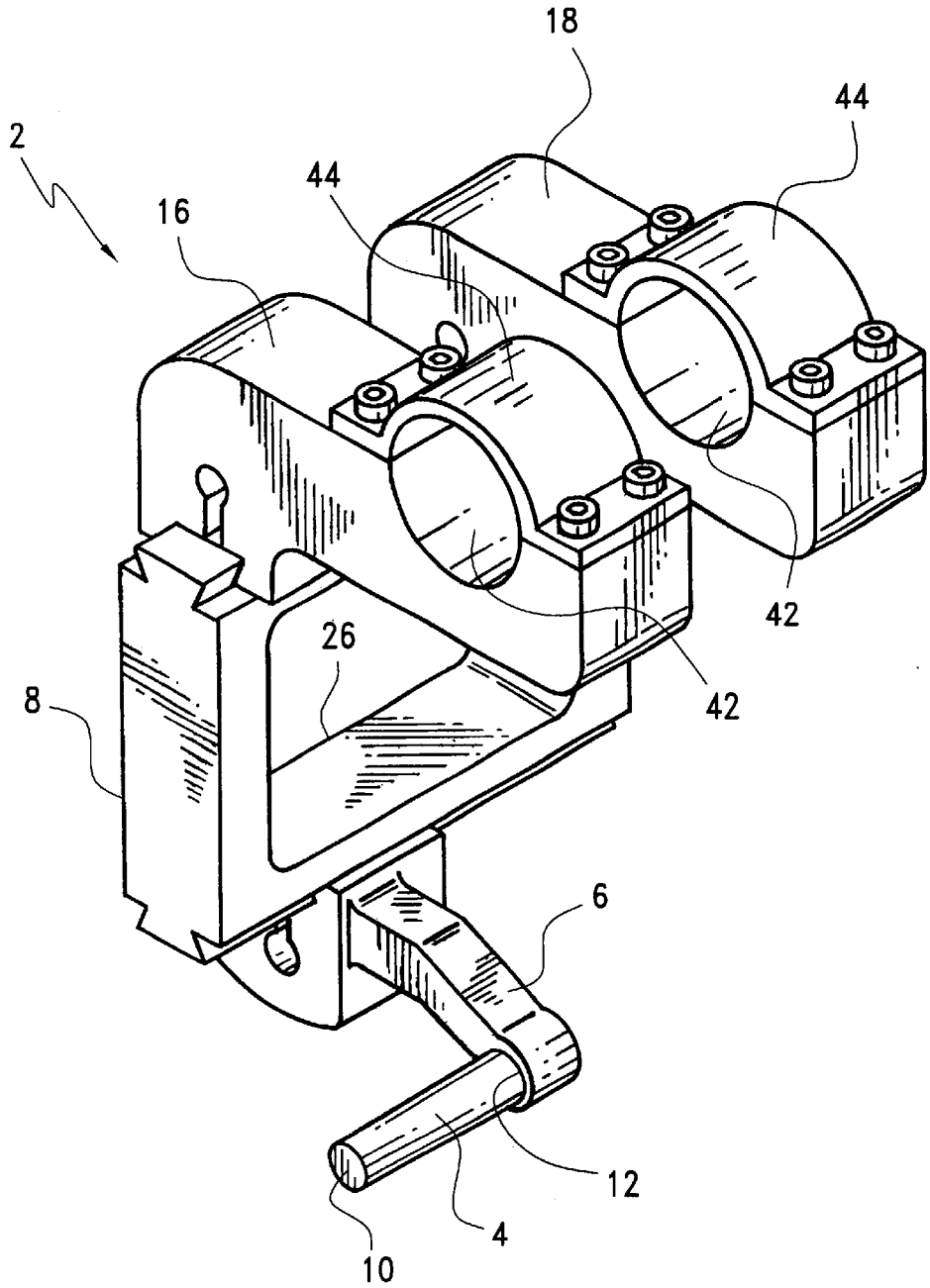
FIG. 1 is a pictorial view of one embodiment of the invention.

Preferably, the bracket is generally rectangularly shaped and has an upper rail 24, a lower rail 26, a front upright post 28 connecting the upper rail to the lower rail, and a back upright post 30 connecting the upper rail to the lower rail. (See FIG. 3). The arm is connected to a front portion of the lower rail (See FIG. 1). The front extension is connected to a front portion of the upper rail. The back extension is connected to a back portion of the upper rail. The stop protrudes transversely from the back upright post. The arm and extension legs are preferably provided with clamp means 32 (see FIG. 4) for connecting to the rails, and are preferably longitudinally adjustable along the rails to accommodate a variety of rifle brands and calibers, and rifle-riflescope-ring combinations.

Generally speaking, the longitudinal axis of the mandrel and the longitudinal axis of the scope are separated by a distance in the range of from about 3.5 to about 5 inches and define an imaginary first vertical plane. A central plane of the bracket is generally parallel to the first plane and is spaced apart from the first plane at a distance generally in the range of from about 1.25 to about 3 inches. A distal end of the stop is generally positioned at a distance in the range of from about 0.25 to about 0.75 inches from the first vertical plane and about ½ way between the longitudinal axis of the mandrel and the longitudinal axis of the scope.

More preferably, the longitudinal axis of the mandrel and the longitudinal axis of the scope are separated by a distance of about 4 to about 5 inches, the central plane of the bracket is spaced apart from the first plane at a distance in the range of from about 1.4 to about 1.8 inches, and the distal end of the stop is positioned at a distance in the range of from about 0.5 to about 0.75 inches from the first vertical plane. See FIG. 4.

Although the stop can have most any desired shape, a stop formed from a generally rectangularly shaped plate which is shorter than either the arm or the extension legs has been used with good results.

In the illustrated embodiment, the lower rail comprises a downwardly facing dovetail tenon 34 extending the length of the lower rail and an outer end of the arm comprises an upwardly facing dovetail mortise 36 mounted to the tenon. Similarly, the upper rail comprises an upwardly facing dovetail tenon 38 extending the length of the upper rail, and an outer end of each extension leg comprises a downwardly facing dovetail mortise 40 mounted to the upwardly facing tenon. The scope is mounted in a pair of saddles 42 (See FIG. 1) formed one each on an inner end upper surface of each extension leg and is retained in position by a pair of split ring retainers 44 mounted one each over the saddles to clamp the scope between the saddles and the split rings. Also, the arm bends downwardly as it extends away from the bracket to improve clearances. See FIG. 4.

A blank cartridge or case can be used as the mandrel. Preferably, however, the mandrel is precision machined to closely replicate a portion of the chamber of the rifle on which it is to be used. A tapered mandrel constructed of brass will provide good results. The mandrel preferably has a generally conically shaped peripheral surface, at least along a section corresponding to a generally conically shaped section of the cartridge or case it replaces, which is, generally speaking, the section between the extractor groove and the shoulder for rimless bottlenecked cartridges. A frusto-conically shaped mandrel has been used with good results.

For use, the checker device is provided with a checker scope. The checker scope is sighted-in to coincide with the sight-in previously determined for the rifle scope on the rifle to be checked. The mandrel of the checker device is positioned in the chamber of the rifle and the checker device is placed in the predetermined position with respect to the rifle with which it was previously sighted in. The rifle is placed in a stable position with the rifle scope centered on a target and the checker scope is viewed to determine whether it is also centered on the target. If it is not, the reticle of the rifle scope can be adjusted to bring it to the same point of aim as the checker scope.

Preferably, the checker device further comprises a stop to contact an outer surface of the rifle scope when the checking device is in the predetermined position, and the mandrel fits the rifle chamber sufficiently closely so that the checker scope can be placed in the predetermined position with a repeatability within a minute of angle as measured with respect to a bore axis of the rifle, or bullet impact point. The checker device is preferably dimensioned so that the checker scope is positioned vertically above the rifle scope when the checking device is in the predetermined position.

While certain preferred embodiments of the invention have been described herein, the invention is not to be construed as being so limited, except the extent that such limitations are found in the claims.

What is claimed is:

1. Apparatus comprising:

a mandrel for closely fitting a rifle chamber, said mandrel having a longitudinal axis, a front end, and a back end;

an arm mounted to the back end of the mandrel and extending transversely outwardly from the longitudinal axis of the mandrel;

a bracket mounted to the arm for mounting a sighting device to sight along a path approximately parallel to the axis of the mandrel; and a stop protruding transversely from the bracket in the direction of the arm.

2. Apparatus as in claim 1 comprising a sighting device mounted to the bracket, said sighting device being mounted to the bracket to sight along a path approximately parallel to the axis of the mandrel.

3. Apparatus as in claim 2 wherein the sighting device comprises a scope having a longitudinal axis, and a front extension leg and a back extension leg, said front extension leg and said back extension leg being spaced apart and extending transversely from the scope to connect the scope to the bracket.

4. Apparatus as in claim 3 herein the arm, the stop, and the pair of extension legs each extend transversely from the same side of the bracket and the stop is positioned between the arm and the pair of spaced apart extensions.

5. Apparatus as in claim 4 wherein the bracket is generally rectangularly shaped, having an upper rail, a lower rail, a front upright post connecting the upper rail to the lower rail, and a back upright post connecting the upper rail to the lower rail, wherein the arm is connected to a front portion of the lower rail, wherein the front extension is connected to a front portion of the upper rail, wherein the back extension is connected to a back portion of the upper rail, and wherein the stop protrudes transversely from the back upright post.

6. Apparatus as in claim 5 wherein the longitudinal axis of the mandrel and the longitudinal axis of the scope are separated by a distance in the range of from about 3.5 to about 5 inches and define a first vertical plane, wherein a central plane of the bracket is generally parallel to the first plane and is spaced apart from the first plane at a distance in the range of from about 1.25 to about 3 inches, and a distal end of the stop is positioned at a distance in the range of from about 0.25 to about 0.75 inches from the first vertical plane and about ½ way between the longitudinal axis of the mandrel and the longitudinal axis of the scope.

7. Apparatus as in claim 5 wherein the longitudinal axis of the mandrel and the longitudinal axis of the scope are separated by a distance of about 4 to about 5 inches and define a first vertical plane, wherein a central plane of the bracket is generally parallel to the first plane and is spaced apart from the first plane at a distance in the range of from about 1.4 to about 1.8 inches, and a distal end of the stop is positioned at a distance in the range of from about 0.5 to about 0.75 inches from the first vertical plane and about ½ way between the longitudinal axis of the mandrel and the longitudinal axis of the scope.

8. Apparatus as in claim 7 wherein the stop comprises a generally rectangularly shaped plate and is shorter than the arm or the extension legs.

9. Apparatus as in claim 8 wherein the lower rail comprises a downwardly facing dovetail tenon extending the length of the lower rail and an outer end of the arm comprises an upwardly facing dovetail mortise mounted to the tenon, and the upper rail comprises an upwardly facing dovetail tenon extending the length of the upper rail, and an outer end of each extension leg comprises a downwardly facing dovetail mortise mounted to the upwardly facing tenon.

10. Apparatus as in claim 9 wherein the scope is mounted in a pair of saddles formed one each on an inner end upper surface of each extension leg, said scope being retained in positioned by a pair of split ring retainers mounted one each over the saddles to clamp the scope between the saddles and the split rings.

11. Apparatus as in claim 10 wherein the arm bends downwardly.

12. A method comprising:

providing a rifle having a rifle scope mounted thereon, said rifle having a chamber, said rifle scope having been sighted-in for said rifle, providing a sight-in checker device comprising a mandrel for closely fitting the rifle chamber, said mandrel having a longitudinal axis, a front end, and a back end;

an arm mounted to the back end of the mandrel and extending transversely outwardly from the longitudinal axis of the mandrel;

a bracket mounted to the arm for mounting a checker scope to sight along a path approximately parallel to the axis of the mandrel, and a checker scope mounted to said bracket, said checker scope having been sighted-in to coincide with the sight-in previously determined for the rifle scope when the sight-in checker device is placed in a predetermined position with respect to said rifle, wherein the checker device further comprises a stop to contact an outer surface of the rifle scope when the checker device is in the predetermined position, positioning the mandrel of the checker device in the chamber of the rifle;

positioning the checker device in the predetermined position with respect to the rifle;

positioning the rifle in a stable position with the rifle scope centered on a target; and viewing the checker scope to determine whether it is also centered on the target.

13. A method as in claim 12 wherein the checker device is dimensioned so that the checker scope is positioned vertically above the rifle scope when the checking device is in the predetermined position.

14. A method as in claim 13 wherein the mandrel fits the rifle chamber sufficiently closely so that the checker scope can be placed in the predetermined position with a repeatability within a minute of angle as measured with respect to a bore axis of the rifle.

* * * * *